US006599143B1

(12) United States Patent
Chong, Jr. et al.

(10) Patent No.: US 6,599,143 B1
(45) **Date of Patent: *Jul. 29, 2003**

(54) VARIABLY POSITIONABLE ELECTRICAL CONNECTOR

(75) Inventors: Fay Chong, Jr., Cupertino, CA (US); William L. Grouell, San Ramon, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/724,853

(22) Filed: Nov. 28, 2000

(51) Int. Cl.[7] ..... H01R 13/56
(52) U.S. Cl. ..... 439/247; 439/545
(58) Field of Search ..... 439/247, 79, 80, 439/327, 328, 571, 572, 545, 67, 493, 1, 2–5, 166–169, 248, 32, 174, 171, 640

(56) References Cited

U.S. PATENT DOCUMENTS 5,897,386 A * 4/1999 Baxter et al. ..... 439/79
6,377,471 B1 4/2002 Chong, Jr. et al.

OTHER PUBLICATIONS

AMP Incorporated, *CHAMP .050 Series I Blindmate, Single Connector Attachment (SCA 2) For SCSI Disk Drives*, printed on Oct. 5, 2000 from http://connect.amp.com (linked from http://www.commcon.com).

Jeff Apodaca, *Drive Docking Connectors Simplify Drive Designs*, pp. 2–5, printed Nov. 5, 2000 from http://www.commcon.com/main.

Comm Con Connectors, Inc. *Disk Drive Adapters*, 2 pages, printed Nov. 5, 2000 from http://www.commcon.com/main/driveadapters.html.

* cited by examiner

*Primary Examiner*—P. Austin Bradley
*Assistant Examiner*—Phuong Nguyen
(74) *Attorney, Agent, or Firm*—David W. Victor; Konrad Raynes Victor & Mann LLP

(57) ABSTRACT

A variably positionable electrical connector provides a direct interface for a disk drive or other electrical device to a printed circuit board (PCB), backplane or motherboard of a computer system. The connector has a base (which may comprise a PCB or backplane) and a housing that slides relative to the base to allow the housing to be positioned according to the spacing between the electrical device's power and signal connectors. The housing includes multiple electrical contacts that receive or engage corresponding contacts of the device. Conductors that are electrically coupled to the computer system extend from the base and include portions that are aligned substantially parallel to a direction in which the housing can slide. The housing contacts slidably engage the parallel portions of the conductors and, as the housing is moved, the housing contacts slidably maintain electrical contact with the conductors. Either or both of the computer system's power and signal connectors that engage the device's connectors may be variably positionable, with the conductors of the variably positionable connector being coupled either to a power supply or a signal source (e.g., processor, bus, memory) as appropriate.

59 Claims, 4 Drawing Sheets

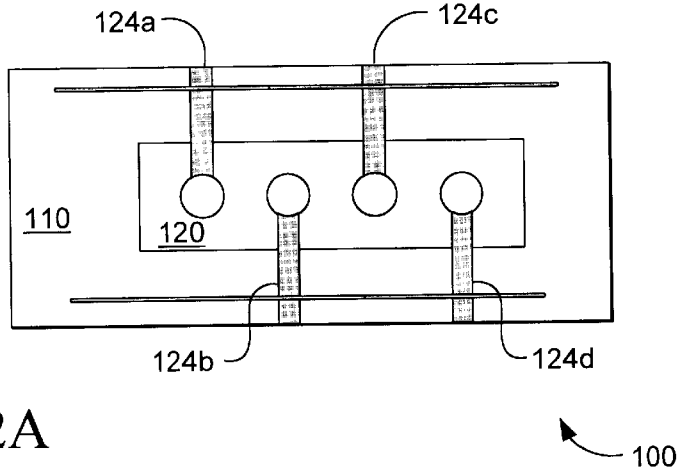
FIG. 2A
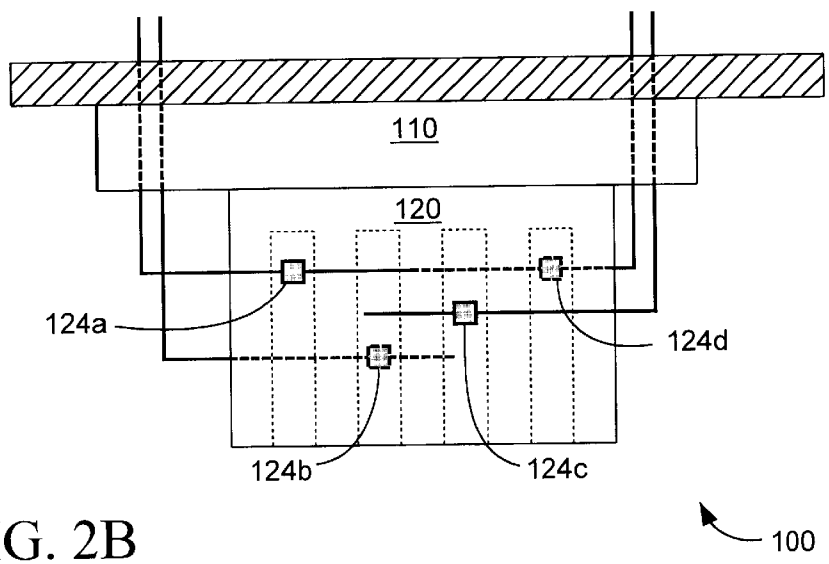
FIG. 2B
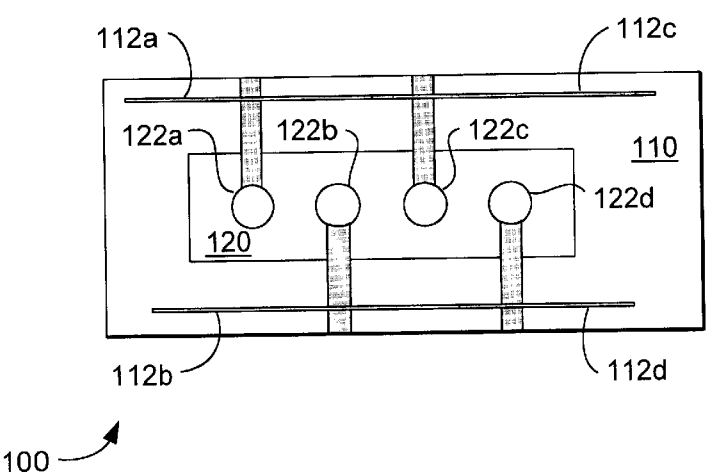
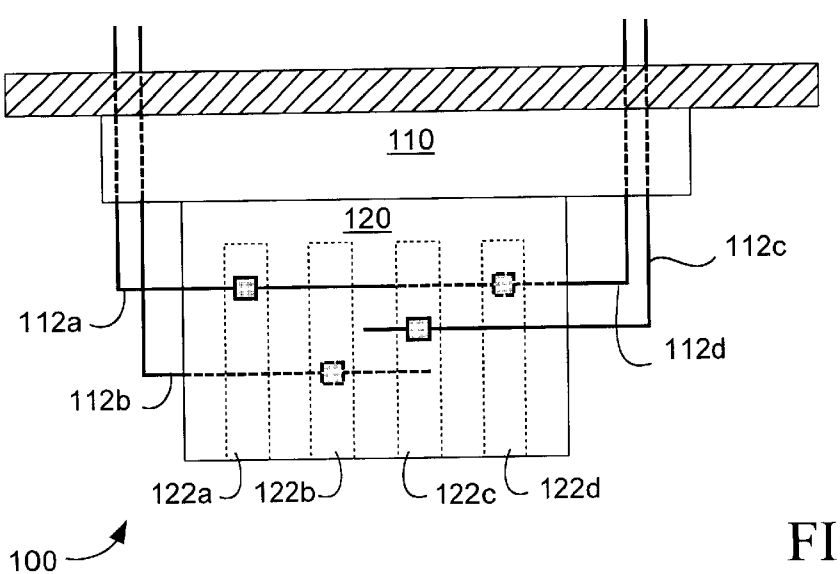

VARIABLY POSITIONABLE ELECTRICAL CONNECTOR

BACKGROUND

This invention relates to the interfacing of a disk drive with a computer system. More particularly, an apparatus and method are provided for directly interfacing disk drives having non-standard or varied spacing between their power and signal connectors.

Disk drives are often connected to a host computer system via cables—usually one set of cables or a ribbon cable for a power connection and another set for a signal connection. The installation of multiple disk drives in one computer system may lead to a Gordian knot of cables, thereby making subsequent peripheral installations or removals, or other system maintenance difficult. Further, the tangle of cables may disrupt the flow of air through the computer system (e.g., for cooling). Yet further, cables provide another point of failure in that they may break or become loose.

Thus, it could make operation of a computer system more reliable, maintenance easier and possibly reduce the cost of system manufacture if disk drives could be installed and operated without the use of conventional power and/or signal cables. However, disk drives are often constructed with non-standard power and signal connector layouts, thus making the direct connection of a disk drive to a printed circuit board (PCB) or backplane problematic. In particular, the spacing between a disk drive's power and signal connectors often varies from one drive to another and from one manufacturer to another. Although standards have been promulgated, not all drives are designed in conformance with them.

Some disk drive manufacturers attempt to reduce the number of cables needed to interface a disk drive to a computer system. Resulting drives, particularly SCSI (Small Computer System Interface) and Fibre Channel, employ Single Connector Attachments (SCA) that provide unified power and signal connections. However, many disk drives are manufactured with separate power and signal connectors instead of SCAs. Even an interposer card, which provides an SCA connector for disk drives having separate power and signal connectors, typically requires one or more cables to complete a connection between the disk drive and the interposer card.

Therefore, what is needed is an apparatus and method for directly interfacing a disk drive (having separate power and signal connectors) with a computer system, without the use of conventional power or signal cabling, wherein the apparatus can accommodate disk drives having a range of spacing (e.g., non-standard or variable) between their power and signal connectors.

SUMMARY

In one embodiment of the invention a variably positionable apparatus is provided for directly interfacing a disk drive or other electronic device with a computer system.

A variably positionable apparatus in this embodiment includes a power and/or signal connector having a movable housing containing multiple contacts. The contacts are configured for establishing electrical conductivity with compatible contacts of a disk drive or other electronic device. The housing is movable in at least one dimension, thus allowing the variably positionable apparatus to accommodate devices having a range of spacing between their power and signal connectors.

In this embodiment the contacts of the power or signal connector housing slidably engage conductors that are coupled to a power or signal source of the computer system. The contacts may encircle, clamp onto, slide against, or maintain some other manner of permanent or semi-permanent engagement with the conductors. The conductors have a relatively fixed position in relation to a connector base, printed circuit board (PCB), backplane, motherboard or other computer system module on which the variably positionable power or signal connector is mounted.

The conductors may, in one embodiment, comprise a base portion extending perpendicular to the connector base or PCB, and a leg portion aligned substantially parallel to the base or PCB. Thus, in this embodiment the contacts of the movable connector housing may slide along the leg portions of the conductors to maintain electrical conductivity between the power or signal source of the computer system and the electronic device.

In alternative embodiments, the movable housing may be mounted on a surface of the base, or may be mounted within or through a channel or aperture defined by the base. The base may be a PCB, backplane, motherboard or other means of interconnecting elements of the computer system.

DESCRIPTION OF THE FIGURES

FIGS. 2A–2B are front and top views of the variably positionable electrical connector of FIG. 1.

DETAILED DESCRIPTION

The following description is presented to enable any person skilled in the art to make and use the invention, and is provided in the context of particular applications of the invention and their requirements. Various modifications to the disclosed embodiments may be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

An environment in which a present embodiment of the invention is executed may incorporate a general-purpose computer or a special purpose device such as a hand-held computer. Some details of such devices (e.g., processor, memory, display) may be omitted for the sake of clarity.

In one embodiment of the invention a variably positionable apparatus is provided for interfacing a disk drive or other electronic device or component to a computer system, and may be implemented as a power connector and/or a signal connector. A portion of the connector is movable, in at least one dimension, in order to accommodate devices having a range of spacing between their power and signal connectors. In this embodiment, contacts in the movable portion of the variably positionable power or signal connector slidably engage conductors that electrically couple the apparatus to the computer system, thereby allowing the connector to maintain power or signal conductivity between the computer system and the device as the connector is positioned or repositioned.

Different embodiments of the invention may be implemented in different types of computer systems and for different types of devices. In particular, however, one or more embodiments of the invention are described below for use with a typical desktop or general-purpose computer employing ATA (Advanced Technology Attachment) or IDE (Integrated Drive Electronics) disk drives. One skilled in the art will appreciate that the disclosed apparatus may be implemented for other types of computer systems (e.g., portable, workstation, minicomputer), disk drives (e.g., SCSI), including magnetic and optical (e.g., CD-ROM), and other devices.

Figure 1:
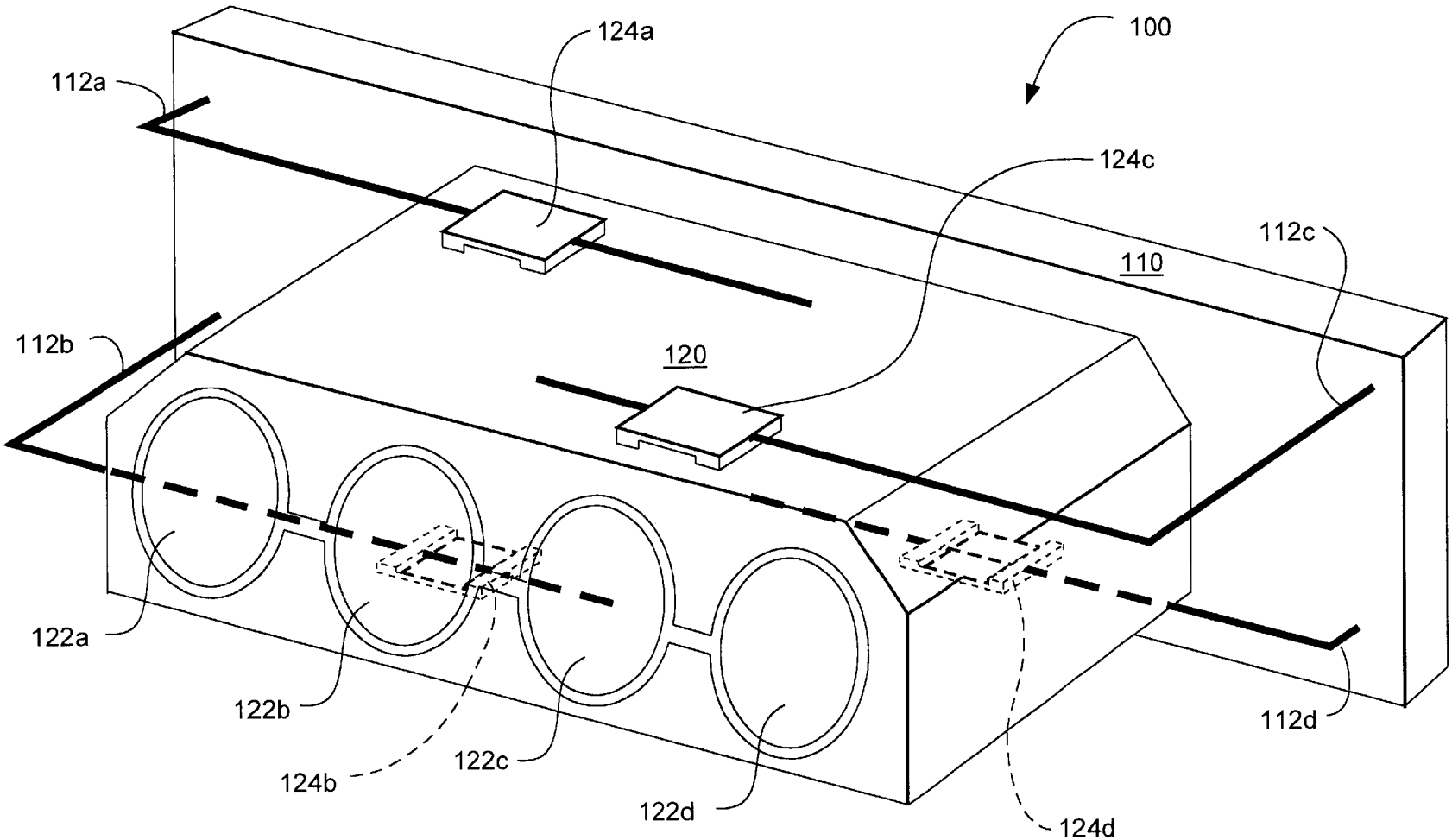
FIG. 1 is a variably positionable electrical connector according to one embodiment of the invention.

FIG. 1 depicts variably positionable power connector 100 for directly interfacing a disk drive or other electrical component to a computer system, according to one embodiment of the invention. FIGS. 2A–2B comprise front and top views of connector 100. The movable nature of the connector enables it to accommodate devices having a range of spacings between their power and signal connectors.

In the illustrated embodiment of the invention, connector 100 comprises base 110 and housing 120. The connector further comprises conductors 112*a*, 112*b*, 112*c* and 112*d* extending from base 110. Conductors 112*a*–112*d* comprise base portions leading substantially perpendicularly from the face of the base, and leg portions extending at approximately right angles to the base portions and substantially parallel to the length of the base. Housing 120 includes multiple electrical contacts 122*a*, 122*b*, 122*c* and 122*d*, which are configured to meet or accept compatible contacts of a disk drive or other device.

Base 110 may, in a present embodiment of the invention, be affixed to a printed circuit board (PCB) or other element of a computer system. In yet another embodiment, base 110 may comprise a portion of a PCB, backplane, motherboard or other computer system module. Further, base 110 and conductors 112*a*–112*d*, and possibly housing 120 as well, may be fully or partially encased or enclosed in order to add rigidity and stability to the apparatus and/or insulate the conductors.

Arms 124*a*, 124*b*, 124*c* and 124*d* of contacts 122*a*–122*d* engage with and make electrical contact with conductors 112*a*–112*d*. In the illustrated embodiment, arms 124*a*–124*d* extend through opposing walls of housing 120, and therefore some (e.g., half) of conductors 112*a*–112*d* are situated on one side, or along one wall, of housing 120, and the remainder are arranged along the opposite wall. In alternative embodiments of the invention contacts 122*a*–122*d* or arms 124*a*–124*d* may extend through or be situated on any of the walls of housing 120. Therefore, conductors 112*a*–112*d* may be located adjacent to any wall or walls of the housing. For example, all conductors may be situated adjacent to a single wall if the housing contacts are accessible at that wall. Regardless of the layout of the conductors relative to the housing, each one is placed in electrical contact with one of the housing contacts.

Housing 120 is movable relative to, or along the face of, base 110 in at least one dimension (e.g., parallel to the leg portions of conductors 112*a*–12*d*). In particular, in the illustrated embodiment of the invention housing 120 and contacts 122 are slidable along the legs of conductors 112. Therefore, housing 120 is variably positionable relative to base 110 and conductors 112 without losing direct contact between conductors 112 and contacts 122 (or arms 124). When a disk drive is to be interfaced using connector 100, housing 120 may be moved to a suitable position to mate with the disk drive's power connector—i.e., to provide the necessary distance from a corresponding signal connector (not shown in FIG. 1).

This may be more clearly seen in FIGS. 2A–2B. FIG. 2A includes two front views of connector 100, showing housing 120 in two different positions relative to base 110. FIG. 2B includes two top views of connector 100 corresponding to the views of FIG. 2A. It can be seen that as housing 120 is translated or repositioned relative to base 110, contacts 122*a*–122*d* move or slide along conductors 112*a*–112*d* with the housing. Thus, in this embodiment of the invention the housing and contacts move relative to the base, but the conductors remain relatively fixed.

Connector 100 of FIG. 1 is configured as a power connector, for interfacing with and providing power to a disk drive or other electronic component. Thus, conductors 112*a*–112*d* are coupled to a power supply of the computer system. In one alternative embodiment of the invention a signal connector for providing a data signal connection to a disk drive may be made variably positionable in a similar manner. In this alternative embodiment the connector conductors (of which there could be more than are depicted in FIG. 1) would be coupled to a signal source (e.g., a processor, memory, bus). Thus, either or both of a power connector and a signal connector may be made variably positionable, in one or more dimensions.

Although the connector housing of FIGS. 1 and 2A–2B may be primarily configured for one-dimensional movement of the housing (e.g., along the length of the base), in other embodiments the housing may be movable in two or even three dimensions. The conductors could be configured as necessary. For example, the portion of conductors 112*a*–112*d* that join base 110 could be rotatable and/or extendable, or the conductors could be flexible to allow for multi-dimensional movement of the housing.

In the embodiment of the invention depicted in FIG. 1 and FIGS. 2A–2B, contacts 122 are sleeves or sockets configured to receive male contact pins of a power connector for a disk drive or other device. The male contact pins may be seated at various depths within the sockets, thus making it beneficial for the sockets to extend the majority of the distance from the front of housing 120 toward base 110. Because a portion of contacts 122 extend through the housing to engage conductors 112, electrical power supplied by the computer system to the conductors can be passed to the contacts and the disk drive.

The portions of contacts 122 that continually engage conductors 112 as housing 120 is moved may have any of a number of forms. These contact portions are depicted as arms, wipers or pads 124*a*, 124*b*, 124*c* and 124*d* in FIGS. 1 and 2A–2B. Arms 124 may form integral portions of contacts 122 or may be conductively affixed to the contacts through bonding, soldering or other means.

Arms 124*a*–124*d* may fully or partially encircle conductors 112*a*–112*d* or vice versa, may be forked or otherwise configured to slidably clamp or wipe against the conductors, or may take yet some other form that allows continuous contact with the conductors as the housing is moved. For example, a conductor could have a two-ply configuration (e.g., two parallel elements or surfaces) to sandwich a contact, or vice versa. Or, one or both of the contacts and conductors may take the shape of flat "fingers" for slidably contacting, or wiping against, the other. The manner in which contacts 122*a*–122*d* engage conductors 112*a*–112*d* is not limited to a particular configuration, and may take various forms as would be understood by one of ordinary skill in the art.

Figures 3A, 3B:
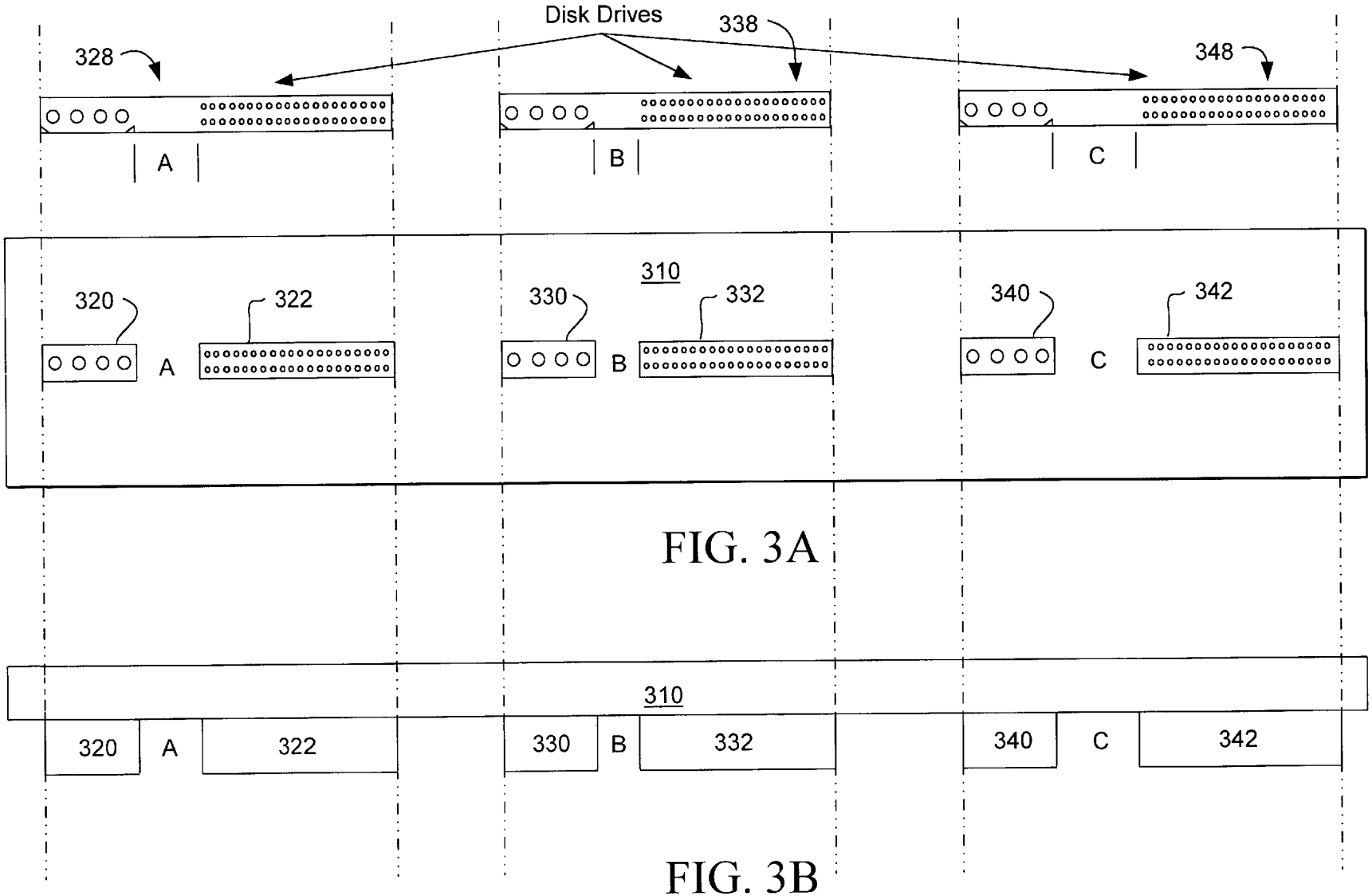
FIGS. 3A–3B are front and top views of a set of variably positionable electrical connectors interfacing a set of disk drives having different spacings between their power and signal connectors, according to one embodiment of the invention.

FIGS. 3A–3B demonstrate the use of multiple variably positionable electrical power connectors to interface a set of disk drives to a computer system. In these figures, a common base 310 hosts variably positionable power connectors 320, 330 and 340. The power connectors cooperate with corresponding signal connectors 322, 332 and 342 to interface with disk drives 328, 338 and 348. In the interest of clarity, the conductors and contacts for each movable power connector are not shown. To meet the different spacings between each disk drive's power and signal connectors, represented by distances A, B and C, each of connectors 320, 330 and 340 are placed in the appropriate positions relative to their signal connectors.

Figure 4A:
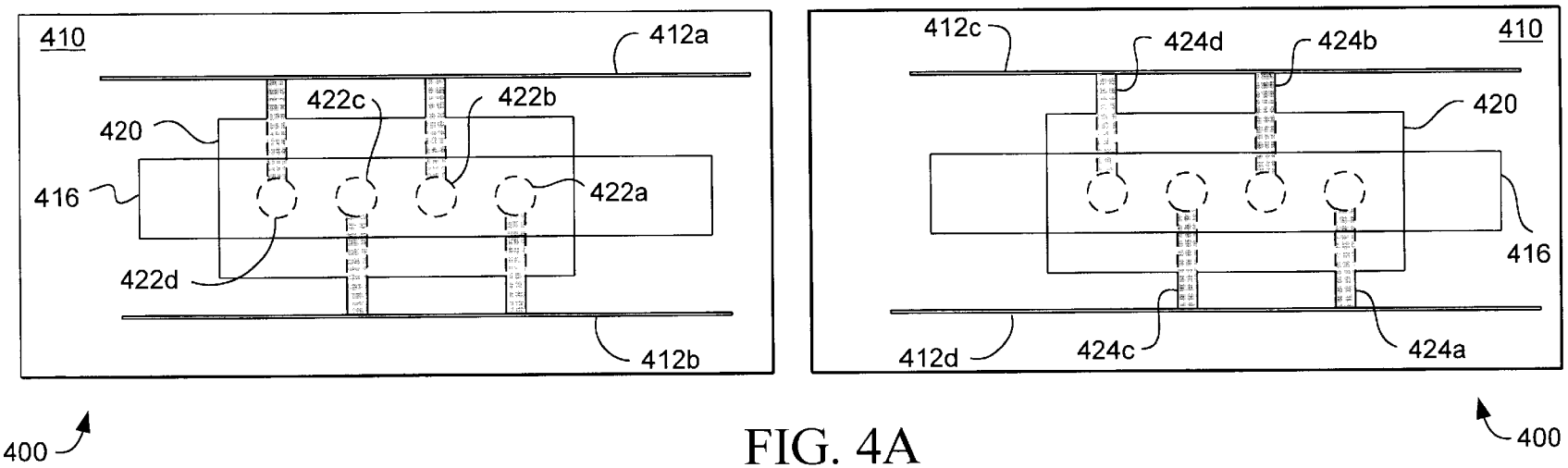
FIGS. 4A–4B are rear and top views of a variably positionable electrical connector according to one alternative embodiment of the invention.
Figure 4B:
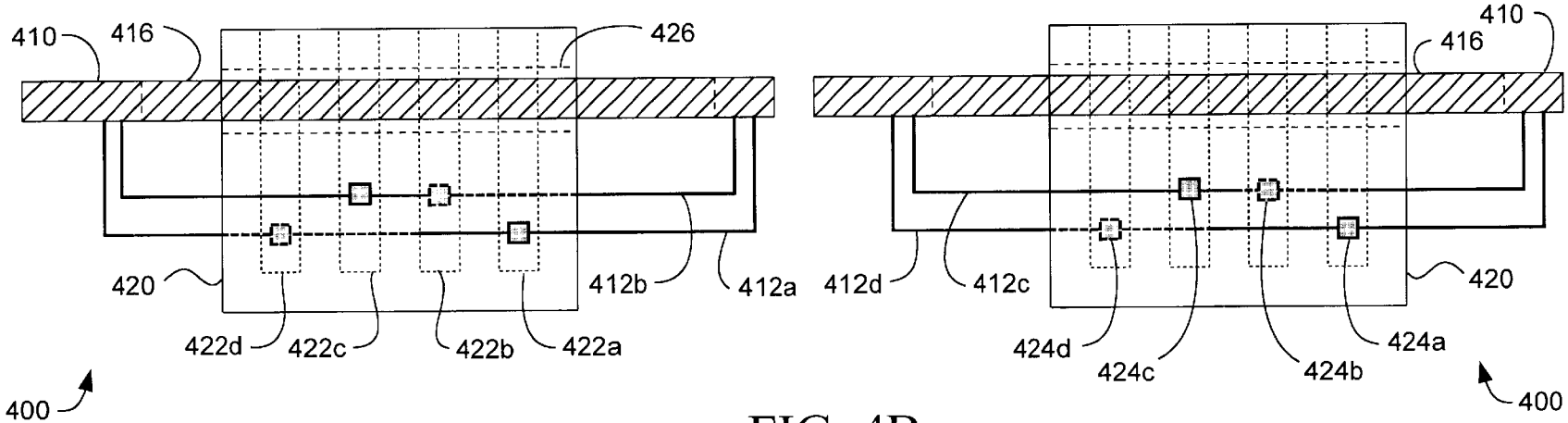

FIGS. 4A–4B depict a variably positionable electrical power connector according to one alternative embodiment of the invention. In this alternative embodiment of the invention the movable housing is mounted within or through a channel or aperture defined by a PCB, backplane, motherboard or other interconnection module acting as a base.

FIG. 4A comprises two rear views of connector 400 as movable housing 420 is located in two different positions relative to base 410 which, in this embodiment may be a PCB, backplane or motherboard. FIG. 4B comprises two corresponding top views. In the illustrated implementation of this embodiment, base 410 includes aperture 416 through the base. Aperture 416 extends relatively further lengthwise (i.e., the direction in which housing 420 can move) than it does heightwise. Housing 420 includes flange, groove or ridge 426, or other means of slidably engaging or gripping an edge of aperture 416. The portion of base 410 that defines aperture 416 may include a corresponding or cooperative channel or groove, or may exhibit some other configuration suitable for movably receiving flange 426 or housing 420.

Illustratively, flange 426 and aperture 416 are configured to allow housing 420 to be moved within the length of aperture 416, and yet minimize movement of the housing perpendicular to the base. In other embodiments, however, connector 400 may be configured to allow housing 420 to move in multiple dimensions.

In the embodiment of the invention illustrated in FIGS. 4A–4B, conductors 412*a*–412*d* are situated on the rear or reverse side of base 410, and contacts 422*a*–422*d* and contact arms 424*a*–424*d* are located nearer the proximal end of housing 420, rather than the distal end that receives the contacts of a compatible disk drive or other device. In other embodiments or implementations of this embodiment, the conductors and contacts may be situated on either or both sides of the base. Further, although housing 420 extends through aperture 416 in the illustrated embodiment, in another embodiment the housing may be slidably mounted within an aperture, channel or groove that does not fully extend through the base.

The foregoing descriptions of embodiments of the invention have been presented for purposes of illustration and description only. They are not intended to be exhaustive or to limit the invention to the forms disclosed. Accordingly, the above disclosure is not intended to limit the invention; the scope of the invention is defined by the appended claims.

What is claimed is:

1. A variably positionable electrical connector for interfacing an electrical device with a computer system, comprising:

a base;

a first housing mounted to the base, said first housing comprising a first set of contacts configured to establish electrical connection with a first set of corresponding contacts on the electrical device;

a second housing comprising a second set of contacts configured to establish electrical connection with a second set of corresponding contacts of the electrical device, said second housing being movably mounted to the base; and a set of conductors connected to the base, each conductor being configured to maintain electrical connection with one of the second set of contacts in the second housing as said second housing is moved relative to the base.

2. The variably positionable electrical connector of claim 1, wherein said base is one of a circuit board and a backplane of the computer system.

3. The variably positionable electrical connector of claim 1, further comprising:

a circuit board;

wherein said base is mounted to the circuit board.

4. The variably positionable electrical connector of claim 1, wherein:

said second housing comprises a flange; and said base comprises an aperture configured to slidably engage said flange.

5. The variably positionable electrical connector of claim 1, wherein said base comprises an aperture and said second housing is slidably mounted in said aperture.

6. The variably positionable electrical connector of claim 1, wherein the second housing is one of a power connector and a signal connector, and the electrical device is a disk drive.

7. The variably positionable electrical connector of claim 1, wherein each of said set of conductors comprises a base portion extending substantially perpendicular to said base and a leg portion aligned substantially parallel to said base.

8. The variably positionable electrical connector of claim 1, wherein each of said second set of contacts comprises:

a sleeve configured to receive the corresponding contact from the second set of corresponding contacts of the electrical device; and an arm configured to continuously engage one of said conductors as said second housing is moved relative to the base.

9. The variably positionable electrical connector of claim 1, wherein;

said base comprises an obverse side and a reverse side; and said second housing comprises a distal end and a proximal end, said distal end of said second housing being located on the obverse side of the base and being configured to accept said second set of corresponding contacts of the electrical device.

10. The variably positionable electrical connector of claim 9, wherein said set of conductors is mounted on said obverse side of said base.

11. The variably positionable electrical connector of claim 8, wherein said set of conductors is mounted on said reverse side of said base.

12. A connector for electrically coupling a device with a computer system, comprising:

a base;

a first housing mounted to the base, said first housing comprising a first set of electrical contacts configured to establish electrical connection with a first set of corresponding contacts an the device;

a second housing slidably engaging said base, said second housing comprising:

a second set of electrical contacts; and a distal end configured to allow coupling of said second set of electrical contacts with a second set of corresponding contacts on the device; and a set of conductors configured to electrically couple the second set of electrical contacts in the second housing with a computer system, wherein said second set of electrical contacts slidably engage said set of conductors as said second housing slides relative to said base.

13. The connector of claim 12, wherein each conductor in said set of conductors comprises a base portion extending substantially perpendicular to said base and a leg portion aligned substantially parallel to said base, and each contact in said second set of electrical contacts slidably engages said leg portion of one of said conductors.

14. The connector of claim 12, wherein one or more of sad set of conductors are mounted on a side of said base facing said distal end of said second housing.

15. The connector of claim 12, wherein one or more of said conductors are mounted on a side of said base facing a proximal end of said second housing.

16. The connector of claim 12, wherein said second housing is mounted through an elongated aperture defined by said base and is variably positionable within a length of said aperture.

17. The connector of claim 12, wherein the second housing is one of a power connector and a signal connector, and the device is a disk drive.

18. A system comprising:

an electrical device having a first set of device contacts and a second set of device contacts;

a base;

a first housing mounted to the base, said first housing comprising a first set of contacts configured to establish electrical connection with a first set of device contacts on the electrical device;

a second housing comprising a second set of contacts configured to establish electrical connection with a second set of device contacts of the electrical device, said second housing being movably mounted to the base; and a set of conductors connected to the base, each conductor being configured to maintain electrical connection with one of the second set of contacts in the second housing as said second housing is moved relative to the base.

19. The system of claim 18, wherein said base is a circuit board.

20. The system of claim 18, further comprising:

a circuit board;

wherein said base is mounted to the circuit board.

21. The system of claim 18, wherein:

said second housing comprises a flange; and said base comprises an aperture configured to slidably engage said flange.

22. The system of claim 18, wherein said base comprises an aperture and said second housing is slidably mounted in said aperture.

23. The system of claim 18, wherein in the second housing is one of a power connector and a signal connector, and the electrical device is a disk drive.

24. The system of claim 18, wherein each of said set of conductors comprises a base portion extending substantially perpendicular to said base and a leg portion aligned substantially parallel to said base.

25. The system of claim 18, wherein each of said second set of contacts comprises:

a sleeve configured to receive the corresponding contact from the second set of corresponding contacts of the electrical device; and an arm configured to continuously engage one of said conductors as said second housing is moved relative to the base.

26. The system of claim 18, wherein:

said base comprises an obverse side and a reverse side; and said second housing comprises a distal end and a proximal end, said distal end of said second housing being located on the obverse side of the base and being configured to accept said second set of corresponding contacts of the electrical device.

27. The system of claim 26, wherein said set of conductors is mounted on said obverse side of said base.

28. The system of claim 26, wherein said set of conductors is mounted on said reverse side of said base.

29. A method of connecting an electrical device having a first and second set of device contacts, said first set of device contacts being separated from the second set of device contacts by a first distance, comprising:

providing a device interface, said device interface comprising:

a base;

a first housing comprising a first set of contacts corresponding to the first set of device contacts;

a second housing comprising a second set of contacts corresponding to the second set of device contacts, said second housing being movably mounted to the base; and a set of conductors connected to the base, each conductor being configured to maintain electrical connection with one of the second set of contacts in the second housing as the second housing is moved relative to the base;

positioning the second housing relative to the base such that the first set of contacts in the first housing and the second set of contacts in the second housing are separated by the first distance; and connecting the electrical device by mating the first sat of device contacts with the first set of contacts in the first housing and mating the second set of device contacts with the second set of contacts in the second housing.

30. The method of claim 29, wherein said positioning the second housing relative to the base comprises sliding the second housing within an aperture provided in the base.

31. The method of claim 29, wherein:

said electrical device is a disk drive;

said first set of contacts is one of a power connector and a signal connector; and said second set of contacts is one of a power connector and a signal connector.

32. The apparatus of claim 29, wherein:

each of said second set of contacts comprises a sleeve and an arm;

said positioning the second housing relative to the base comprises moving the second housing while each arm continuously engages one of the set of conductors; and said connecting comprises inserting the first set of device contacts into the sleeves of the first set of contacts in the first housing and inserting the second set of device contacts into the sleeves of the second set of contacts in the second housing.

33. A variably positionable electrical connector for interfacing an electrical device with a computer system, comprising:

a base;

a housing comprising a set of contacts configured to establish electrical connection with a set of corresponding contacts of the electrical device, said housing being movably mounted to the base; and a set of conductors connected to the base, each conductor being configured to maintain electrical connection with one of the set of contacts in the housing as said housing is moved relative to the base.

34. The variably positionable electrical connector of claim 33, further comprising:

arms that engage the conductors, wherein the arms extend through the housing and maintain continuous contact with the conductors as the housing is moved.

35. The variably positionable electrical connector of claim 33, wherein the housing is moved to mate with a power connector of the electrical devices.

36. The variably positionable electrical connector of claim 33, wherein the housing is capable of moving in multiple dimensions.

37. The variably positionable electrical connector of claim 33, wherein the contacts comprise sockets configured to receive contact pins of the electrical device.

38. The variably positionable electrical connector of claim 33, wherein the contacts extend through the housing to engage the conductors.

39. The variably positionable electrical connector of claim 33 for interfacing with a plurality of electrical devices, further comprising:

at least one additional housing comprising an additional set of contacts configured to establish electrical connection with a set of corresponding contacts of one of the electrical devices, wherein each additional housing is movably mounted to the base; and an additional set of conductors for each additional housing connected to the base, wherein the conductors in each additional set of conductors is configured to maintain electrical connection with one of the additional sets of contacts in the additional housing as said additional housing is moved relative to the base.

40. The variably positionable electrical connector of claim 33, wherein said set of conductors comprises a flexible set of conductors.

41. The variably positionable electrical connector of claim 40, wherein the housing and contacts move relative to the conductors, wherein the contacts and conductors maintain continuous contact as the housing is moved.

42. A connector for electrically interfacing a device with a computer system, comprising:

a base;

a housing slidably engaging said base, said housing comprising:

(i) a set of electrical contacts; and (ii) a distal end configured to allow coupling of said set of electrical contacts with a set of corresponding contacts on the device; and (iii) a set of conductors configured to electrically couple said set of electrical contacts in the housing with a computer system, wherein each of said set of conductors engage one of said set of contacts as said housing slides relative to said base.

43. The connector of claim 42, wherein said set of conductors comprises a flexible set of conductors.

44. The connector of claim 42, wherein the housing is moved to mate with a power connector of the electrical devices.

45. The connector of claim 42, wherein the housing is capable of moving in multiple dimensions.

46. The connector of claim 42, wherein the contacts comprise sockets configured to receive contact pins of the electrical device.

47. The connector of claim 42, wherein the contacts extend through the housing to engage the conductors.

48. The connector of claim 42 for interfacing with a plurality of electrical devices, further comprising:

at least one additional housing comprising an additional set of contacts configured to establish electrical connection with a set of corresponding contacts of one of the electrical devices, wherein each additional housing is movably mounted to the base; and an additional set of conductors for each additional housing connected to the base, wherein the conductors in each additional set of conductors is configured to maintain electrical connection with one of the additional sets of contacts in the additional housing as said additional housing is moved relative to the base.

49. The connector of claim 42, further comprising:

arms that engage the conductors, wherein the arms extend through the housing and maintain continuous contact with the conductors as the housing is moved.

50. The connector of claim 49, wherein the housing and contacts move relative to the conductors, wherein the contacts and conductors maintain continuous contact as the housing is moved.

51. A system, comprising:

an electrical device having a set of device contacts;

a base;

a housing comprising a set of contacts configured to establish electrical connection with the set of device contacts of the electrical device, said housing being movably mounted to the base; and a set of conductors connected to the base, each conductor being configured to maintain electrical connection with one of the set of contacts in the housing as said housing is moved relative to the base.

52. The system of claim 51, wherein said set of conductors comprises a flexible set of conductors.

53. The system of claim 51, further comprising:

arms that engage the conductors, wherein the arms extend through the housing and maintain continuous contact with the conductors as the housing is moved.

54. The system of claim 51, wherein the housing and contacts move relative to the conductors, wherein the contacts and conductors maintain continuous contact as the housing is moved.

55. The system of claim 51, wherein the housing is moved to mate with a power connector of the electrical device.

56. The system of claim 51, wherein the housing is capable of moving in multiple dimensions.

57. The system of claim 51, wherein the contacts comprise sockets configured to receive contact pins of the electrical device.

58. The system of claim 51, wherein the contacts extend through the housing to engage the conductors.

59. The system of claim 51, for interfacing with a plurality of electrical devices, further comprising:

at least one additional housing comprising an additional set of contacts configured to establish electrical connection with a set of corresponding contacts of one of the electrical devices, wherein each additional housing is movably mounted to the base; and an additional set of conductors for each additional housing connected to the base, wherein the conductors in each additional set of conductors is configured to maintain electrical connection with one of the additional sets of contacts in the additional housing as said additional housing is moved relative to the base.

* * * * *